US010266318B2

(12) United States Patent
Callanan et al.

(10) Patent No.: US 10,266,318 B2
(45) Date of Patent: Apr. 23, 2019

(54) SOLAR JAR LID

(71) Applicants: Brian Joseph Callanan, Buffalo, NY (US); Jesse Callanan, Buffalo, NY (US); Madeleine Callanan, Buffalo, NY (US)

(72) Inventors: Brian Joseph Callanan, Buffalo, NY (US); Jesse Callanan, Buffalo, NY (US); Madeleine Callanan, Buffalo, NY (US)

( * ) Notice: Subject to any disclaimer, the term of this patent is extended or adjusted under 35 U.S.C. 154(b) by 0 days.

(21) Appl. No.: 15/918,276

(22) Filed: Mar. 12, 2018

(65) Prior Publication Data

US 2018/0257829 A1 Sep. 13, 2018

Related U.S. Application Data

(60) Provisional application No. 62/470,413, filed on Mar. 13, 2017.

(51) Int. Cl.

| | |
|---|---|
| ***F21S 9/03*** | (2006.01) |
| ***A47G 19/22*** | (2006.01) |
| ***B65D 47/36*** | (2006.01) |
| ***B65D 51/24*** | (2006.01) |
| ***F21V 33/00*** | (2006.01) |

(52) U.S. Cl.

CPC ..... *B65D 51/248* (2013.01); *A47G 19/2227* (2013.01); *B65D 47/36* (2013.01); *A47G 2019/2238* (2013.01); *A47G 2200/08* (2013.01); *B65D 2231/022* (2013.01); *F21S 9/037* (2013.01); *F21V 33/0036* (2013.01)

(58) Field of Classification Search

CPC ... B65D 51/248; B65D 47/36; A47G 19/2227
See application file for complete search history.

(56) References Cited

U.S. PATENT DOCUMENTS

| | | | | |
|---|---|---|---|---|
| 7,080,916 | B1 * | 7/2006 | Ferrin | A47G 19/2227 220/705 |
| 8,662,696 | B2 * | 3/2014 | Lederer | B65D 51/248 362/154 |
| 9,353,920 | B2 * | 5/2016 | Callanan | F21L 4/08 |
| 9,493,267 | B1 * | 11/2016 | Citrin | F21V 23/0492 |

* cited by examiner

*Primary Examiner* — Thomas M Sember
(74) *Attorney, Agent, or Firm* — Del Vecchio and Stadler LLP

(57) ABSTRACT

A solar jar lid having a solar unit and having a support housing that supports the solar unit, and wherein the solar unit has a light emitting diode. The support housing has an internal thread such that it can be threaded to ajar and defines an opening for receiving a straw. The support housing is capable of being threaded to a jar. When the light emitting diode is turned on a beverage in the jar is illuminated. In another embodiment the support housing is replaced with a tabbed support housing, and in another embodiment the support housing is replaced with a clamp arm support housing. The solar unit includes a solar panel and rechargeable battery and may include an on and off switch. The user fills the jar with a beverage and the light emitting diode illuminates the beverage as the user drinks the beverage through the straw.

16 Claims, 11 Drawing Sheets

SOLAR JAR LID

CROSS REFERENCE TO RELATED APPLICATION

This application claims the benefit of U.S. Provisional Patent Application No. 62/470,413 filed on Mar. 13, 2017, the contents and disclosure of which is hereby incorporate herein by reference.

BACKGROUND

People enjoy drinking beverages at all times of the day. The beverages are usually packaged in large two or three liter bottles and the user must pour the beverage into a container, for example a glass, cup or even a water bottle. In addition, many people drink beverages when it is dark outside, for example at the beach or in their backyard, at an outdoor bar, or while camping.

However, when drinking beverages in low or no light conditions, the beverage container can be misplaced or lost, or can be tipped over in which case the beverage is lost. In addition, the person consuming the beverage may spill the beverage while trying to drink the beverage.

Thus, what is needed is an easy to use, easy to manufacture and inexpensive device that ends the problems associated with drinking beverages at night. It would be desirable if the device were re-useable and adapted for use in different applications.

SUMMARY

A solar jar lid is provided having a support housing and a solar unit, ant the solar unit is supported on the support housing. The solar unit has a solar unit housing and fitted and supported in the solar unit housing is a power and control housing. The power and control housing supports a solar panel and houses a rechargeable battery and solar panel circuitry, and the power and control housing supports a light emitting diode (hereinafter referred to as LED) has an on and off switch. The support housing defines a straw opening and has an internal thread. The support housing internal thread is capable of being threaded to an external thread of a jar holding a beverage. The LED can be turned on and is powered by the rechargeable battery. The LED is supported on the power and control housing such that LED faces the jar and so that light emitted from the LED illuminates the beverage A straw is moved through, extended through or manually slid through the straw opening.

In another embodiment the support housing is replaced with a tabbed support housing that is capable of being threaded to a segmented thread jar, and in another embodiment the support housing is replaced with a clamp arm support housing that is capable of being threaded to a segmented threaded jar.

The LED is illuminates beverages contained in the jar during the night or in low light conditions and the solar unit has a easy to access on/off switch, or may have a light sensor such that it is automatically turned on or off depending on ambient light conditions.

BRIEF DESCRIPTION OF THE DRAWING FIGURES

DESCRIPTION

Figure 1:
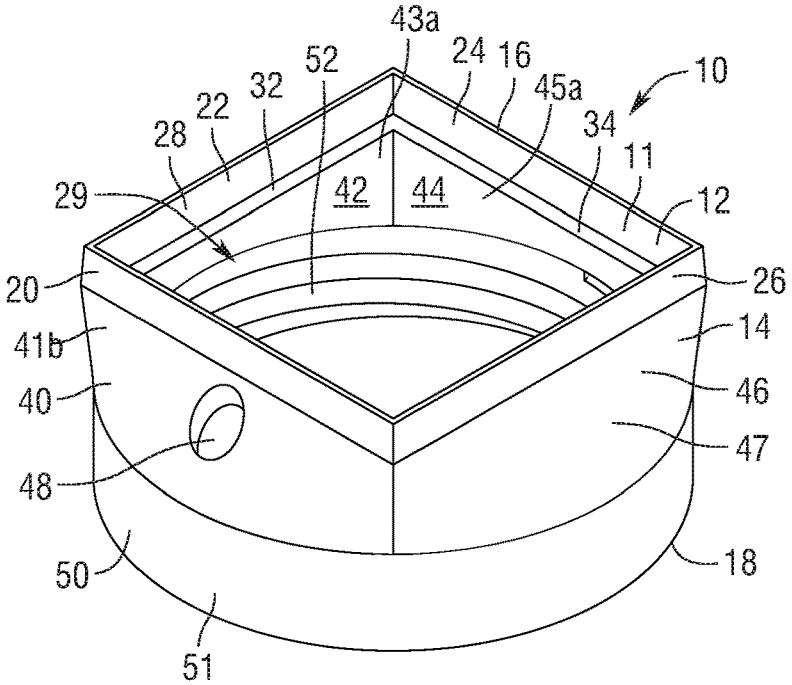
FIG. 1 is a front perspective view of a support housing.
Figure 5:
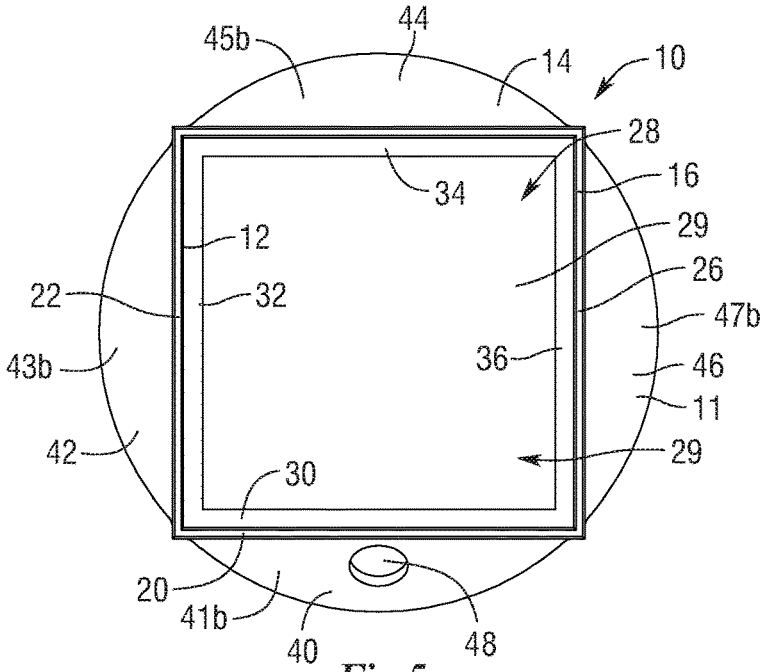
FIG. 5 is a top view of the support housing.
Figure 6:
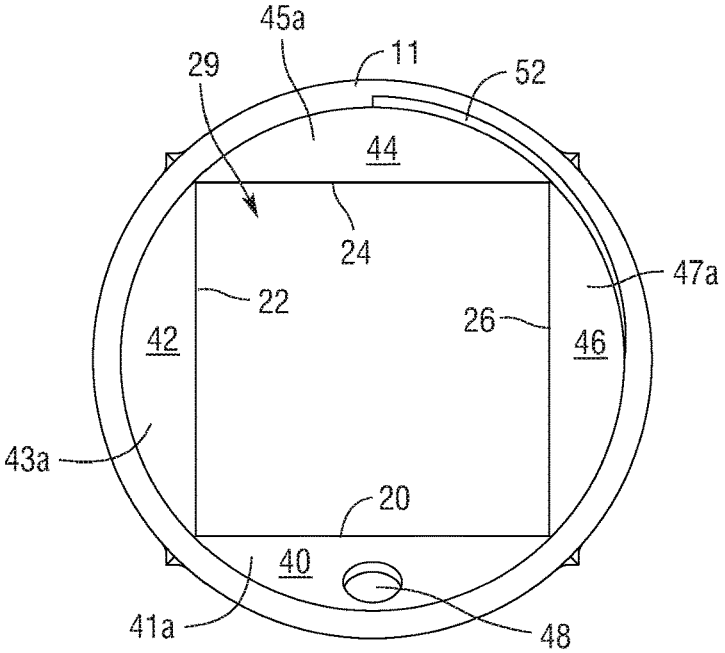
FIG. 6 is a bottom view of the support housing.
Figure 10:
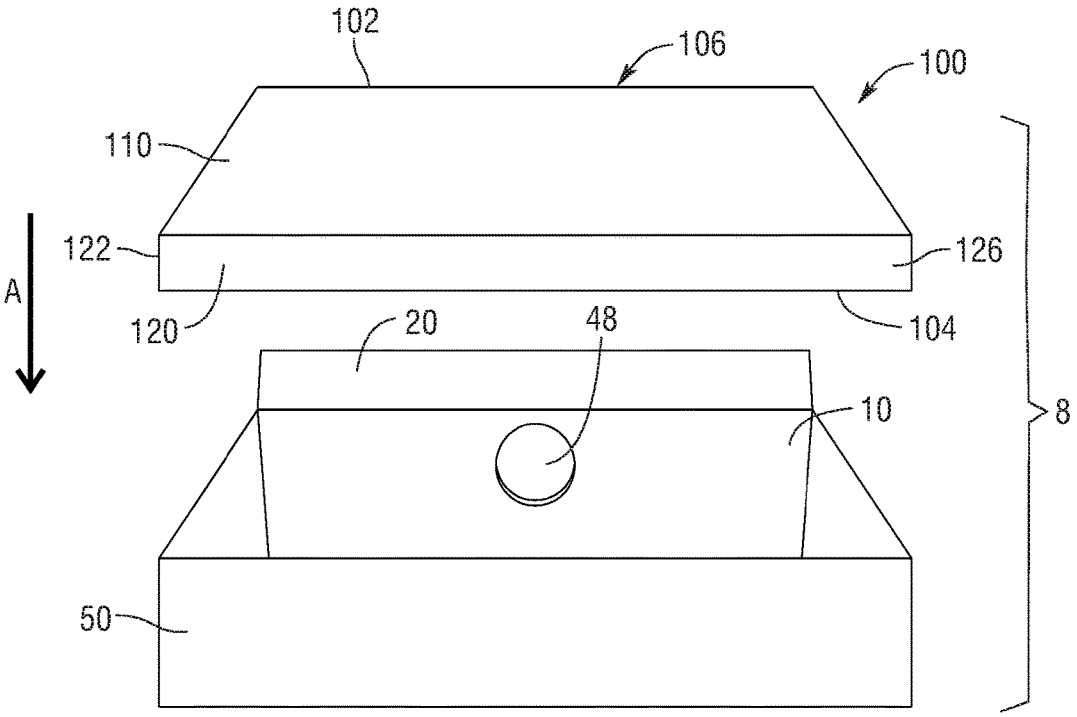
FIG. 10 is a side view of the solar unit an arrow (designated A) showing the direction of movement of the solar unit onto the support housing.
Figure 11:
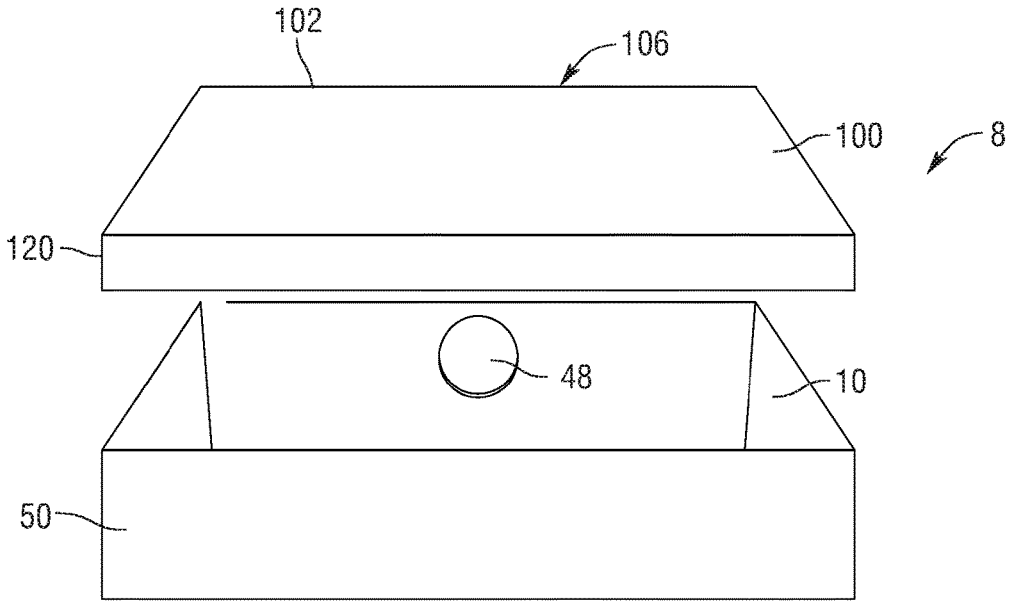
FIG. 11 is a side view showing the solar jar lid wherein the solar unit is supported on the support housing.
Figure 13:
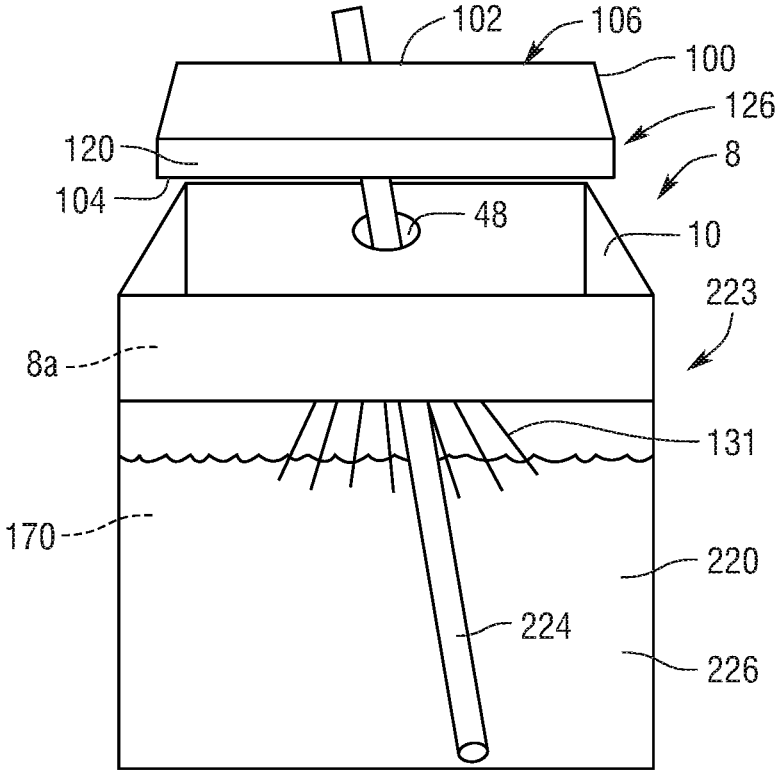
FIG. 13 is a front view of the solar jar lid threaded to a jar and wherein the jar contains a beverage.

As shown in FIGS. 10, 11 and 13 there is shown a solar jar lid 8 that includes a support housing 10 and a solar unit 100. As shown in FIGS. 1-7 the support housing 10 has opposed inner and outer housing surfaces 12, 14, and opposed first and second ends 16, 18. Extending from the first end 16 are first, second, third and fourth support engagement walls 20, 22, 24 and 26, respectively, that together define a support housing opening 28 that extends trough the support housing 10 and that leads to a support housing interior 29. The first and third support engagement walls 20, 24 face one another, and the second and fourth support engagement walls 22, 26, respectively, face one another. The support housing 10 is hollow. As shown in FIGS. 1 and 5, extending from the inner surface 12 are first, second, third and fourth interior stop walls 30, 32, 34 and 36, respectively, that meet with the first, second, third and fourth support engagement walls 20, 22, 24 and 26, respectively.

As shown in FIGS. 1-6, extending from the first, second, third and fourth support engagement walls 20, 22, 24, 26 are a first curved wall 40 having opposed inner concave and outer convex surfaces 41*a*, 41*b*, a second curved wall 42 having opposed inner concave and outer convex surfaces 43*a*, 43*b*, a third curved wall 44 having opposed inner concave and outer convex surfaces 45*a*, 45*b*, and a fourth curved wall 46 having opposed inner concave and outer convex surfaces 47*a*, 47*b*. The first and third curved walls 40, 43 face one another, and the second and fourth curved walls 42, 44 face one another. The firsts curved wall 40 defines a straw opening 48. In other embodiments in addition to the first curved wall 40 defining a straw opening 48, any the remaining second, third and fourth curved walls 42, 44, 46 may also define straw openings 48. The straw opening 48 is sized such that a straw 224 can be passed or extended through the straw opening 48.

Figure 2:
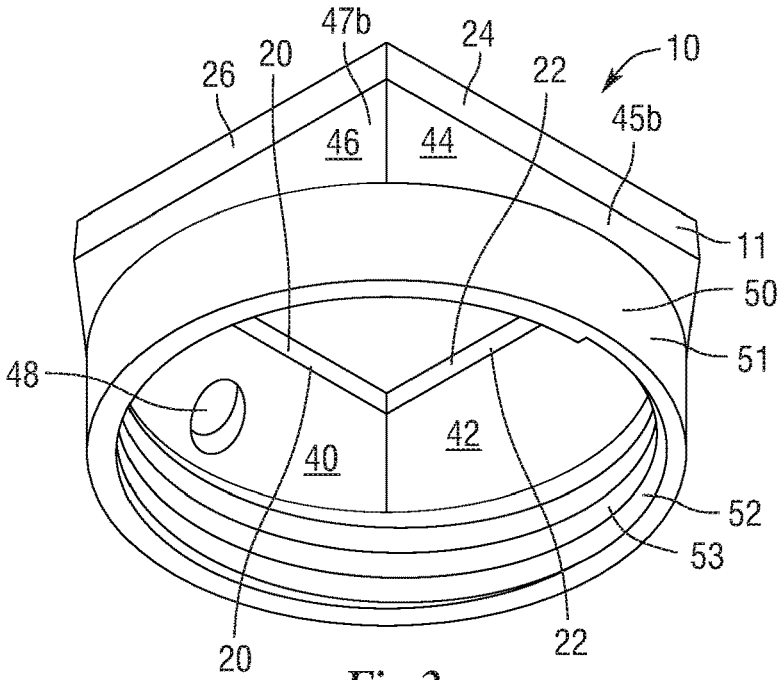
FIG. 2 is a bottom perspective view of the support housing.
Figure 3:
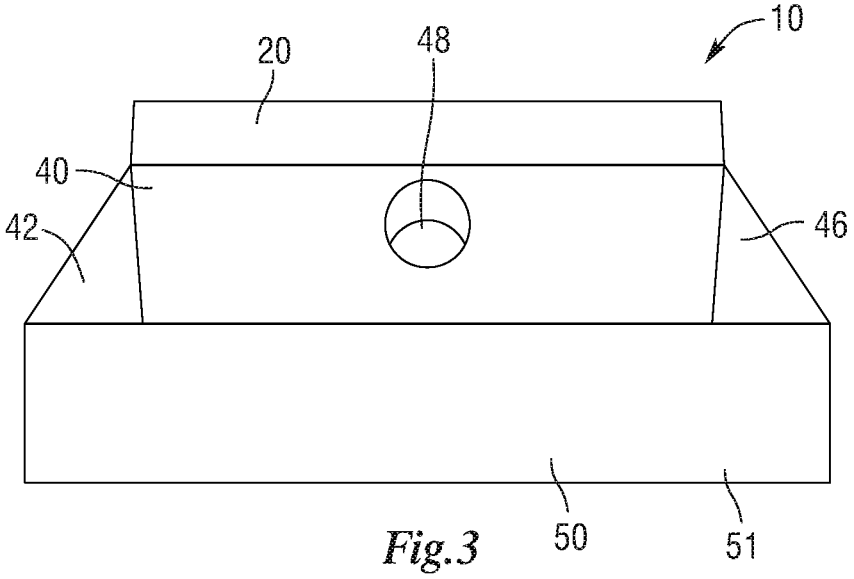
FIG. 3 is a front view of the support housing.
Figure 4:
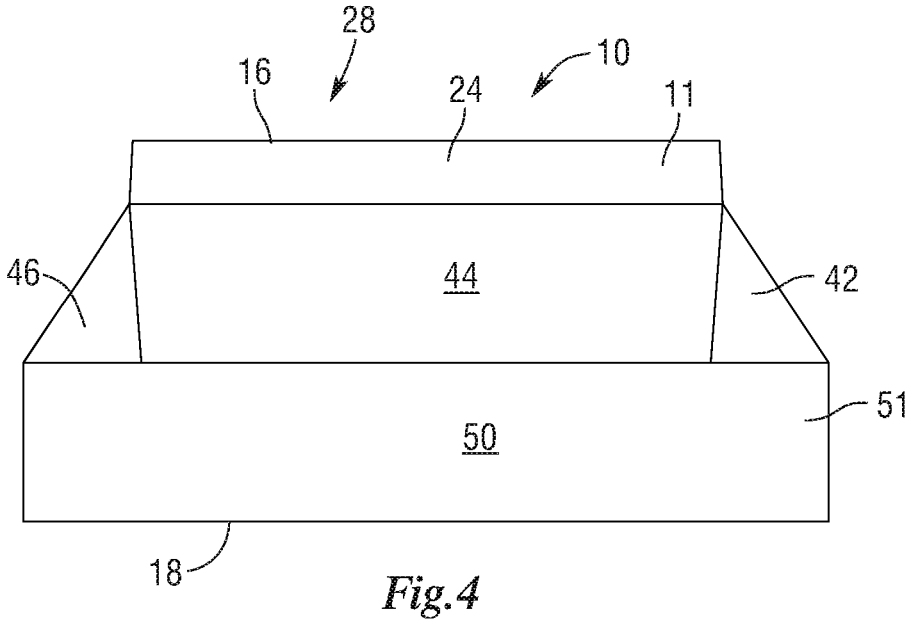
FIG. 4 is a rear view of the support housing.
Figure 7:
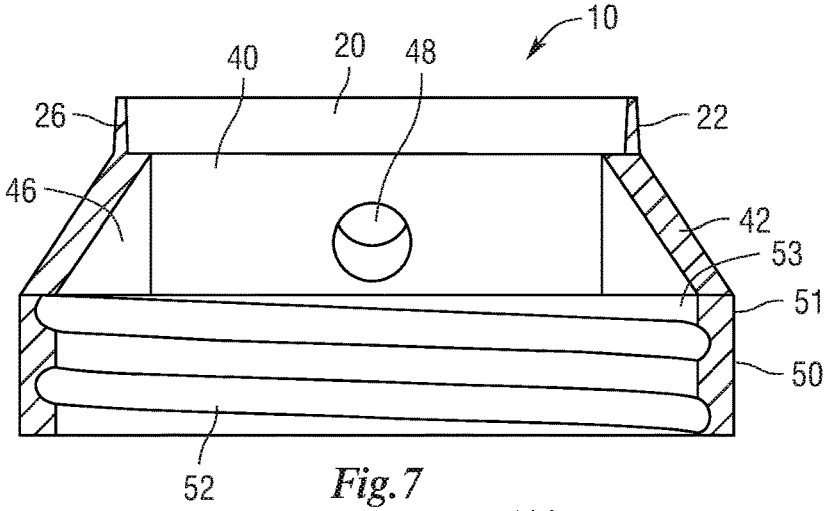
FIG. 7 is a sectional view of the support housing.
Figure 8:
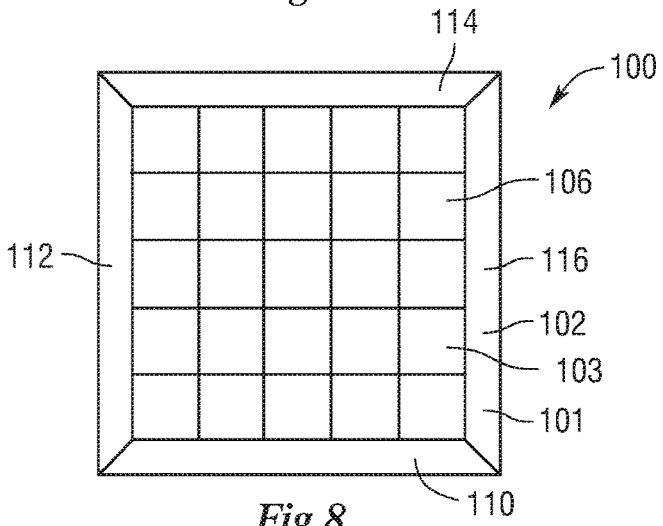
FIG. 8 is a top view of a solar unit and shows a solar panel assembly that is part of the solar unit.

As shown in FIGS. 1 and 2, extending from the first, second, third and fourth curved walls 40, 42, 44, and 46 is a surrounding wall 50 that has a generally circular shape. The surrounding wall 50 extends to the second end 18 of the support housing 10. The surrounding wall 50 has opposed outer and inner wall surfaces 51, 53 as shown in FIGS. 1 and 2. Extending from the inner wall surface 53 of the surrounding wall 50 is an internal thread 52 as shown in FIGS. 2 and 7.

The support housing 10 may be made of plastic, metal, food grade plastics, glass, clear or colored plastics and glass, and other suitable materials. The support housing 10 may be made by, for example, molding, injection molding, three-dimensional printing (3D printing), casting and other suitable methods. It is pointed out that the support housing 10 may be embodied as a one-piece body 11.

Figure 9:
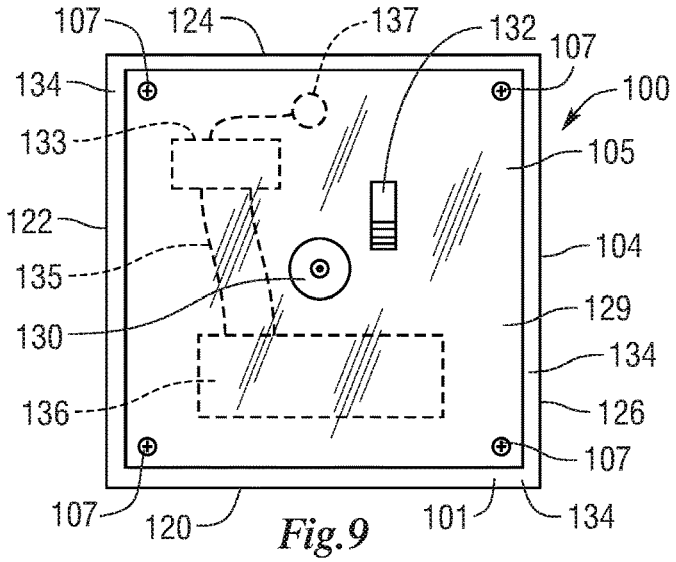
FIG. 9 is a bottom view of the solar unit having a solar unit housing and a power and control housing with the power and control housing secured in the solar unit housing.

As mentioned above, the solar jar lid 8 also includes a solar unit 100, and the solar unit 100 is shown in FIGS. 8-11. The solar unit 100 has a solar unit housing 101 having a first solar unit housing end wall 102 that defines a solar panel opening 103, and having an opposed second solar unit housing end wall 104 that defines a solar housing opening 105. The solar unit housing 101 also has first, second, third and fourth unit sidewalls 110, 112, 114, 116 (FIG. 8) that extend from the first solar unit housing end wall 102. The first and third unit sidewalls 110, 114 face one another, and the second and fourth unit sidewalls 112, 114 face one another. Extending from the first unit side wall 110 is a first engagement wall 120 as shown in FIGS. 9 and 13, extending from the second unit sidewall 112 is a second engagement wall 122, extending from the third unit sidewall 114 is a third engagement wall 124, and extending from the fourth unit sidewall 116 is a fourth engagement wall 126. The first, second, third and fourth unit sidewalls 110, 112, 114, 116 slope outwardly as they extend from the first solar unit housing end wall 102 and in a direction toward the second solar unit housing end wall 104 until they meet with and merge with the first, second, third and fourth engagement walls 120, 122, 124, 126, respectively, and together the first, second, third and fourth engagement walls 120, 122, 124, 126 form the shape of a rectangle and extend to the second solar unit housing end wall 104. The solar unit 100 also includes solar panel 106 that is capable of being fitted in the solar housing opening 105 such that the solar panel 106 can be exposed to a light source and generate electricity, for example the sun (not shown).

As shown in FIG. 9, the solar unit 100 also has a power and control housing 129 that supports the solar panel 106 and that houses the solar lighting circuitry 133, wiring 135, a rechargeable battery 136, and may include a light sensor 137 all shown in dashed line in FIG. 9. The power and control housing 129 also supports an on and off switch 132, and a light emitting diode (LED) 130 that extends from the power and control unit housing 129. The LED 130 is capable of being powered by the solar panel 106. The LED 130 faces in an opposite direction that the solar panel 106 faces. The power and control housing 129 is fitted and positioned internal to the solar unit housing 101 such that the solar panel 106 abuts and is flush with the first solar unit housing end wall 102. The power and control housing 129 is secured to the solar unit housing 101 with adhesives 109 that may be waterproof or fasteners 107, for example screws, or both. As shown in FIG. 9 the fasteners 107 extend through the power and control housing 129 and can tread to the first solar unit housing end wall 102. LEDs and the circuitry and wiring used in connection with solar panels, LEDs, rechargeable batteries, on off switches, and light sensors are all well known to those having ordinary skill in the art and are therefore not described in greater detail herein.

As shown in FIG. 9, the solar unit 100 also defines a slot 134. The slot 134 is defined by the first, second, third and fourth engagement walls 120, 122, 124, 126 and the power and control housing 129, such that the slot 134 extends along each of the first, second, third and fourth engagement walls 120, 122, 124, 126.

As shown in FIGS. 10 and 11 the solar unit 100 is moved onto the support housing 10 as indicated by the arrow designated A to form the solar jar lid 8. As the solar unit 100 is lowered the first, second, third and fourth engagement walls 20, 22, 24 and 26 (FIG. 5) of the support housing 10 move into the slot 134 defined in the solar unit 100. As this happens the first, second, third and fourth engagement walls 120, 122, 124, 126 of the solar unit 100 (FIG. 9) surround the first, second, third and fourth engagement walls 20, 22, 24 and 26 as shown in FIG. 11. Movement stops when the power and control housing 129 of the solar unit 100 contacts and abuts against the first, second, third and fourth interior stop walls 30, 32, 34, and 36 of the support 10. FIG. 11 shows the solar jar lid 8 when assembled. Thus, the solar unit 100 may be readily installed on and removed from the support housing 10. Optionally, a fastener or adhesives may used to secure the solar unit 100 to the support housing 10 in one embodiment.

Figure 12:
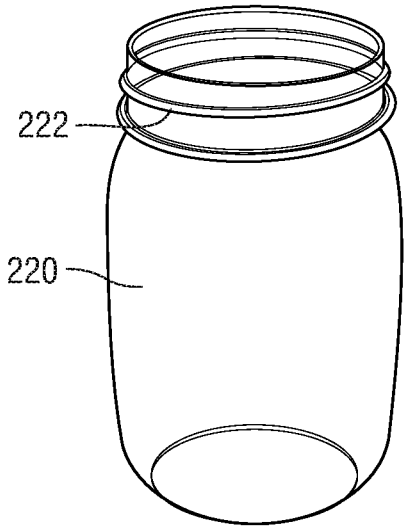
FIG. 12 is a perspective view of a jar having an external thread.

FIG. 12 is a perspective view of a jar 220 having an external thread 222 that is capable of being threaded to the internal thread 52 of the surrounding wall 50 of the support housing 10. The jar 220 may be made of clear glass or plastic, or may be transparent or may be tinted such that light can pass through the jar 220. As shown in FIG. 13, a straw 224 extends through the straw opening 48 such that a user (not shown) can drink a beverage 226 contained in the jar 220 with a straw 224. The LED 130 emits light 131 on the beverage 226 such that the user can enjoy his or her beverage in low light environments, for example outdoor bars, campsites, backyards, festivals and the like. In addition, the LED 130 may also be used to illuminate beverages during daytime hours depending on the amount of ambient light and the color of the beverage. When the jar 220 is empty, the user need only unscrew the solar jar lid 8 from the jar 220 and refill the jar 220 and then screw the solar jar lid 8 back on the jar 220.

It is pointed out that the solar jar lid 8 may be sold at retail outlets without the jar 220. Or, the solar jar lid 8 can be sold along with the jar 220, for example the solar jar lid 8 can be sold already combined with and threaded to the jar 220. The solar jar lid 8 may be made in various sizes and diameters, for example dimensions of the surrounding wall 50 can be varied, such that the internal thread 52 can be threaded to a plurality of differently sized jars 220. And, many people already own jars that would be suitable for use with the solar jar lid 8, and thus they might not want to purchase another jar. Thus, the purchaser has the option to purchase just the solar jar lid 8, or purchase the solar jar lid 8 with the jar 220.

Figure 14:
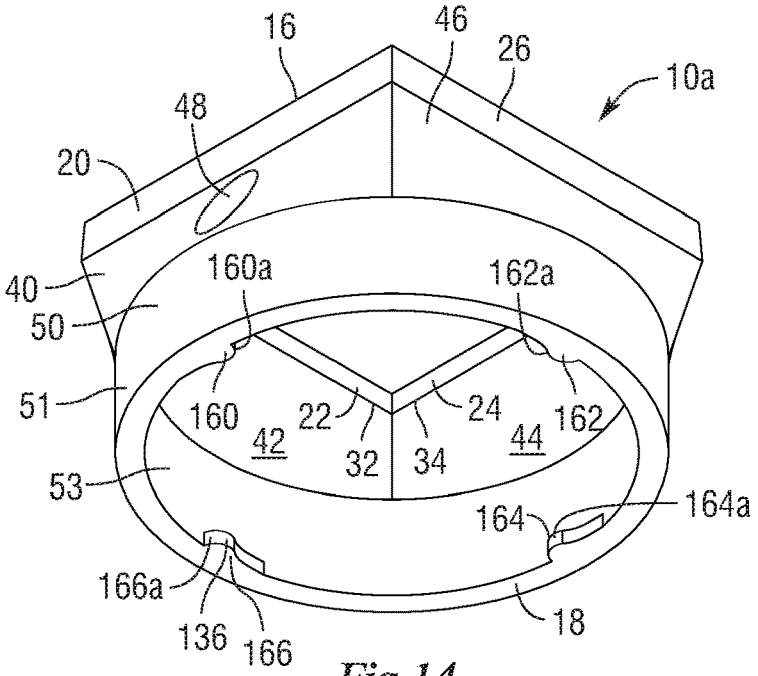
FIG. 14 is a bottom perspective view of a second embodiment wherein there is a tabbed support housing.
Figure 15:
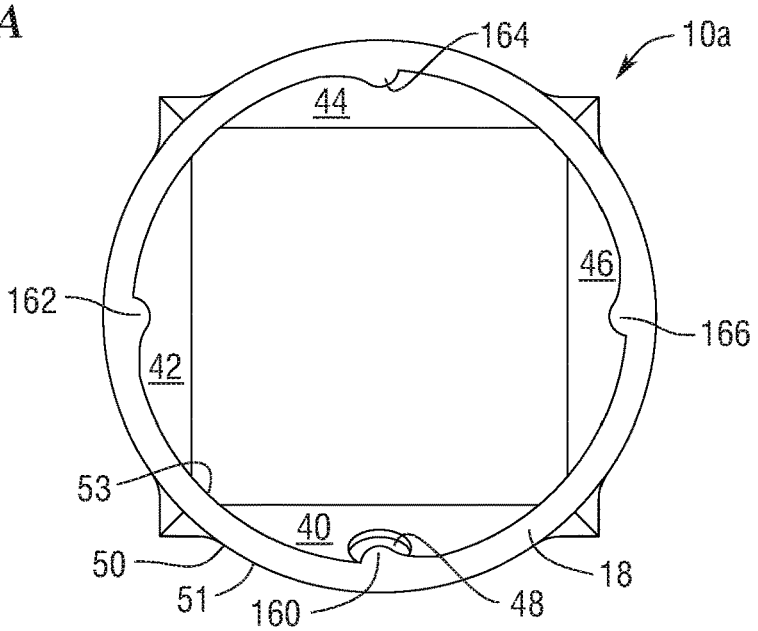
FIG. 15 is a bottom view of the tabbed support housing.
Figure 16:
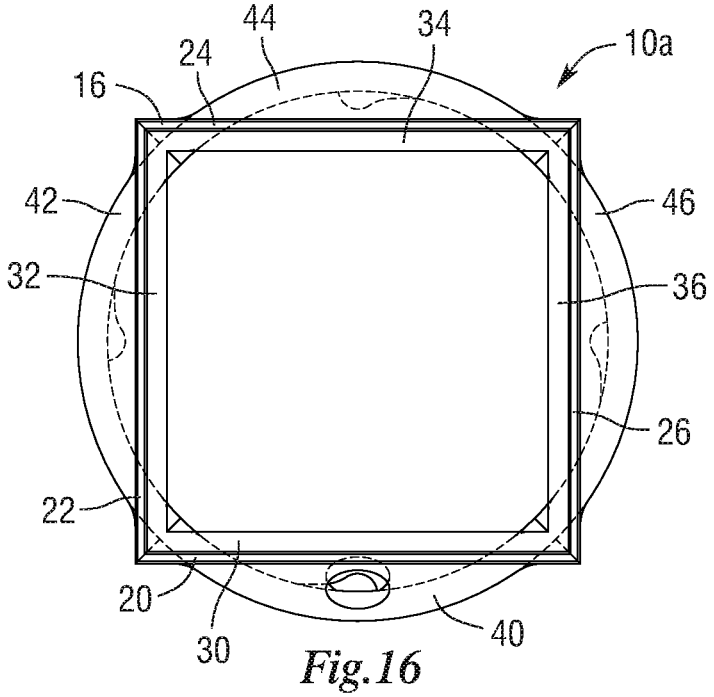
FIG. 16 is a top view of the tabbed support housing.

FIGS. 14-16 show another embodiment of a tabbed solar jar lid **8*a*. In this embodiment the tabbed solar jar lid 8*a* has the solar unit 100 described above, and has a tabbed support housing 10*a* that replaces the support housing 10. The tabbed support housing 10*a* is substantially the same as the above-described support housing 10 and has the same reference numerals, but the above described internal thread 52 is not present and is replaced with first, second, third and fourth engagement tabs 160, 162, 164, 166, respectively. As shown, the surrounding wall 50 has opposed outer and inner wall surfaces 51, 53 that extend to the second end 18 of a tabbed support housing 10***a*. The first, second, third and fourth engagement tabs 160, 162, 164, 166 extend from the inner wall surface 53. The first, second, third and fourth engagement tabs 160, 162, 164, 166 have jar engagement portions 160*a*, 162*a*, 164*a*, 166*a*, respectively. In addition, the first, second, third and fourth engagement tabs 160, 162, 164, 166 extend from the inner wall surface 53 such that they are coplanar or flush with the second end 18 of the tabbed support housing 10*a*.

Figure 14A:
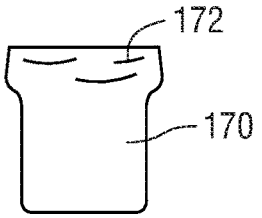
FIG. 14A is a front view of a segmented thread jar that is adapted for use with the tabbed support housing.

The tabbed support housing 10*a* is capable of being be screwed to a segmented thread jar 170 having external tab engagement thread segments commonly designated by reference numeral 172 (FIG. 14A). In one embodiment there are four tab engagement thread segments 172. The segmented thread jar 170 may be made of glass or plastic and is transparent or clear or may be tinted, such that light can pass through the segmented thread jar 170. The jar engagement portions 160*a*, 162*a*, 164*a*, 166*a* engage the four external tab engagement thread segments 172 of the segmented thread jar 170 to hold the tabbed support housing 10*a* to the segmented thread jar 170. After screwing the tab solar jar lid 8*a* to the segmented thread jar 170 and placing the solar unit 100 on top of the tabbed support housing 10*a* the resulting assembly would appear substantially identical to what is shown in FIG. 13. Thus, in FIG. 13 the tab solar jar lid 8*a* and segmented thread jar 170 are shown with dashed reference numeral lines. Jars having tab engagement thread segments are commercially available and their construction and use are well known to those having ordinary skill in the art. The tabbed solar jar lid 8*a* can be sold by itself and the purchaser can use his or her own segmented threaded jar 170, or the tabbed solar jar lid 8*a* can be sold with the segmented thread jar 170 and the user can screw them together.

Figure 17:
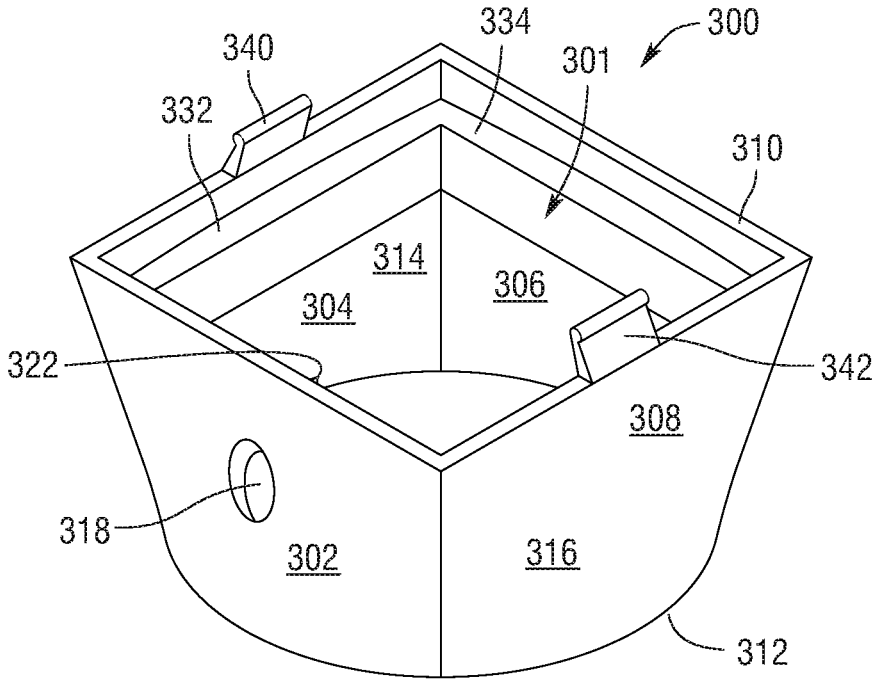
FIG. 17 is a top perspective view of a third embodiment wherein there is a clamp arm support housing.
Figure 18:
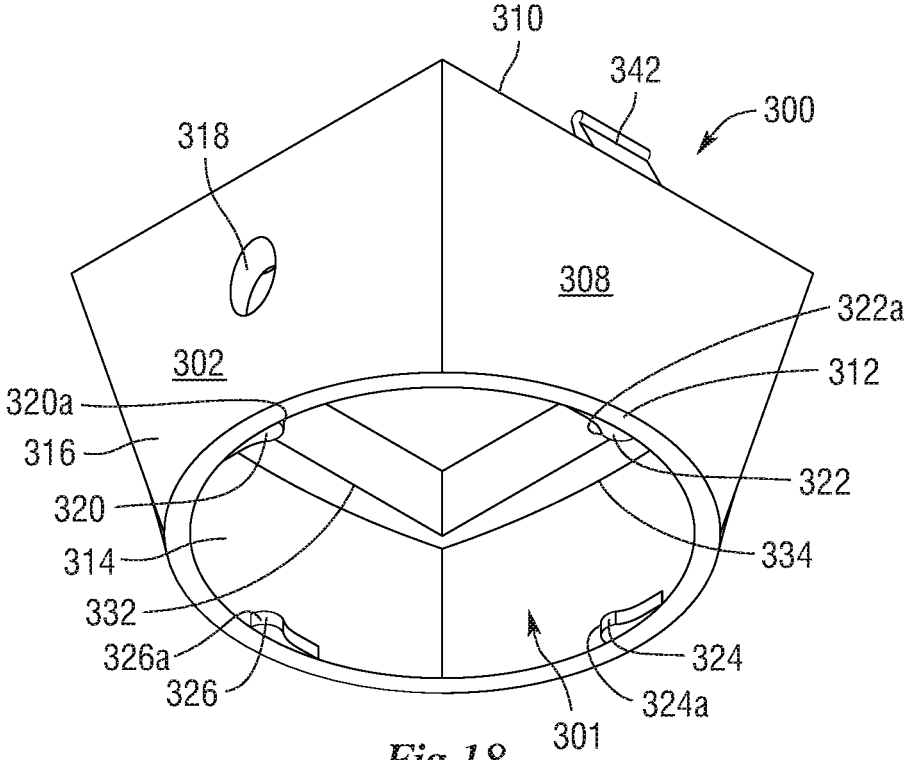
FIG. 18 is a bottom perspective view of the third embodiment showing the clamp arm support housing.

FIGS. 17-22 show a third preferred embodiment wherein there is a clamp arm solar jar lid 8*b* that includes the previously described solar unit 100 and includes a clamp arm support housing 300 that retains the solar unit 100 in place. The clamp arm support housing 300 has an engagement housing interior 301. As shown in FIG. 18 the clamp arm support housing 300 has first, second, third and fourth convex walls 302, 304, 306, 308 that extend from a panel engagement end 310 to an opposed jar engagement end 312. The clamp arm support housing 300 has opposed inner and outer surfaces 314, 316. The first convex wall 302 defines a straw opening 318 for receiving the above-mentioned straw 224. As shown in FIG. 18, extending from the inner surface 314 at the jar engagement end 312 are first, second, third and fourth engagement tabs 320, 322, 324, 326 that are substantially the same as the first, second, third and fourth engagement tabs 160, 162, 164, 166 described above. The first, second, third and fourth engagement tabs 320, 322, 324, 326 have first, second, third and fourth jar engagement portions 320*a*, 322*a*, 324*a*, 326*a*. The first, second, third and fourth engagement tabs 320, 322, 324, 326 are adapted to thread to the segmented thread jar 170 having external tab engagement thread segments 172 as previously described. In another embodiment the first, second, third and fourth engagement tabs 320, 322, 324, 326 are replaced with the previously described internal thread 52 such that the clamp arm support housing 300 can be threaded to the previously described external thread 222 of the jar 220.

Figure 19:
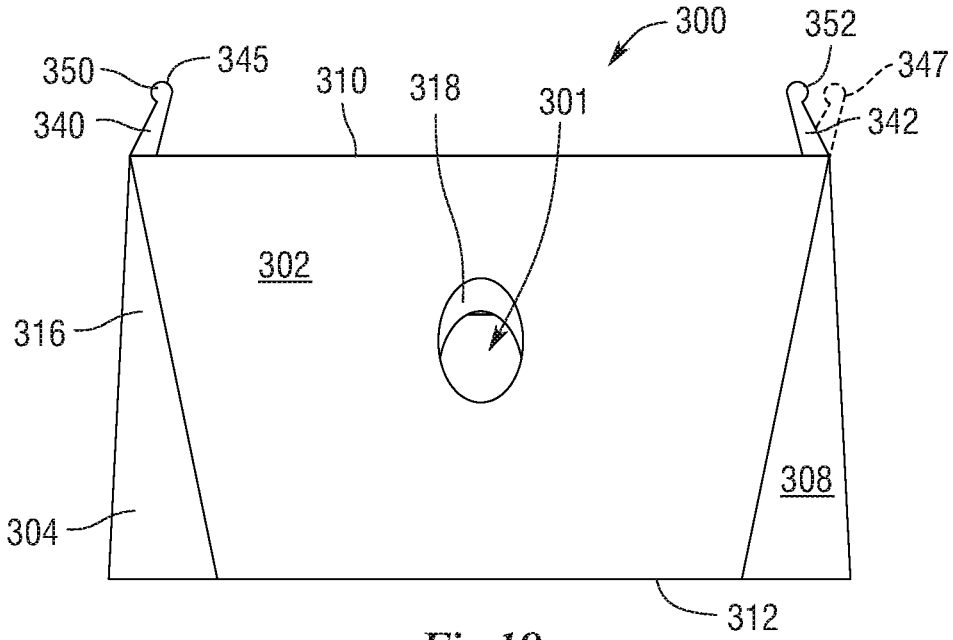
FIG. 19 is a front view of the clamp arm support housing.
Figure 21:
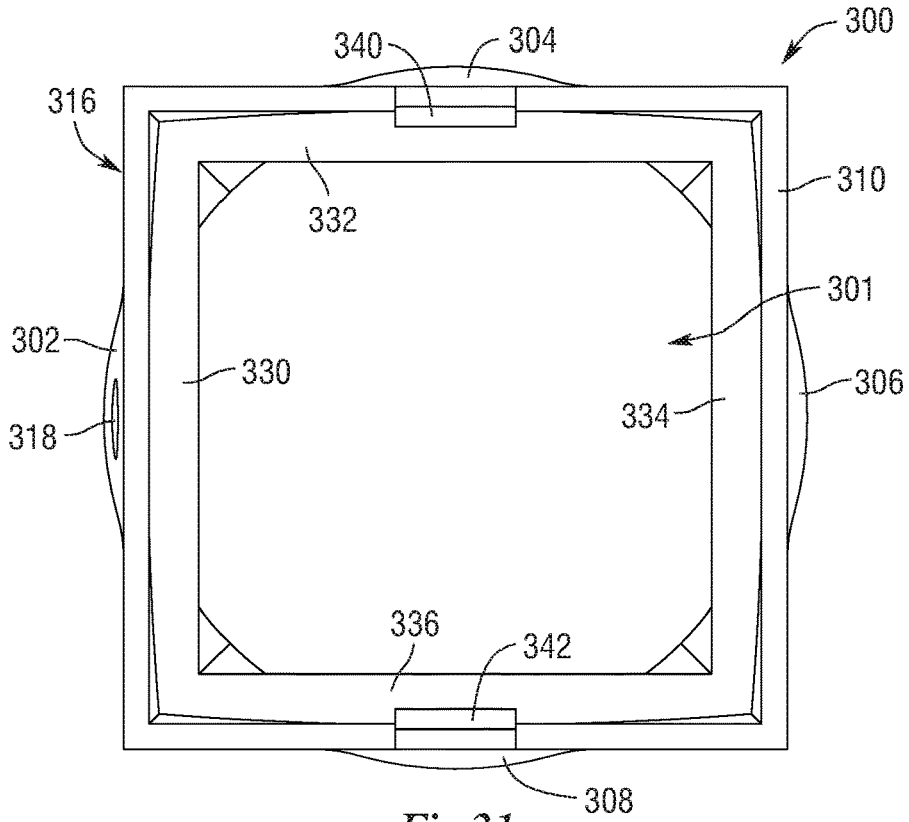
FIG. 21 is a top view of the clamp arm support housing.
Figure 22:
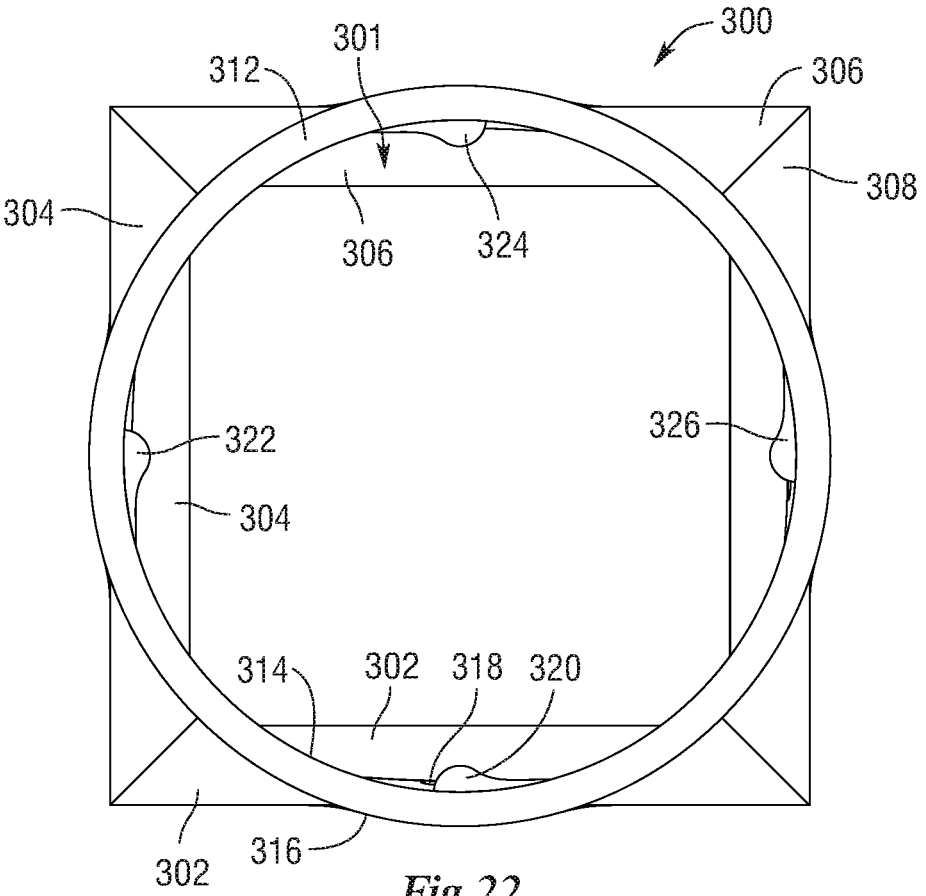
FIG. 22 is a bottom view of the clamp arm support housing.

As shown in FIG. 21, extending from the inner surface 314 are first, second, third and fourth internal stop walls 330, 332, 334, 336. In addition, first and second clamp arms 340, 342 extend from the panel engagement end 310 along the second and fourth convex walls 304, 308, and the first and the first and second clamp arms 340, 342 face one another. As shown in FIGS. 17, 19 and 21, the first clamp arm 340 extends at an angle relative to the panel engagement end 310, such that the first clamp arm extends over the second internal stop wall 332. Similarly, the second clamp arm 342 extends at an angle relative to the panel engagement end 310, such that the second clamp arm 342 extends over the fourth internal stop wall 336 as shown in FIG. 21. The first and second clamp arms 340, 342 slope in a direction toward the housing interior 301. In one embodiment the first and second clamp arms 340, 342 are integrally formed with the panel engagement end 310 as part of the clamp arm support housing 300 when the clamp arm support housing 300 is made. The clamp arm support housing 300 may be made of plastic or metal, and can be manufactured by molding techniques or with three-dimensional printers. In addition, because of the materials used in construction the first and second clamp arms 340, 342 are flexible and resilient. As shown in FIG. 19, the first clamp arm 340 also has a first finger protrusion 350, and the second clamp arm 342 has a second finger protrusion 352 such that they can each be manually bent from a relaxed position 345 to a bent position 347 (shown in dashed line), and then return to the relaxed position 345. The bent position 347 is shown in dashed line in FIG. 19.

Figure 20:
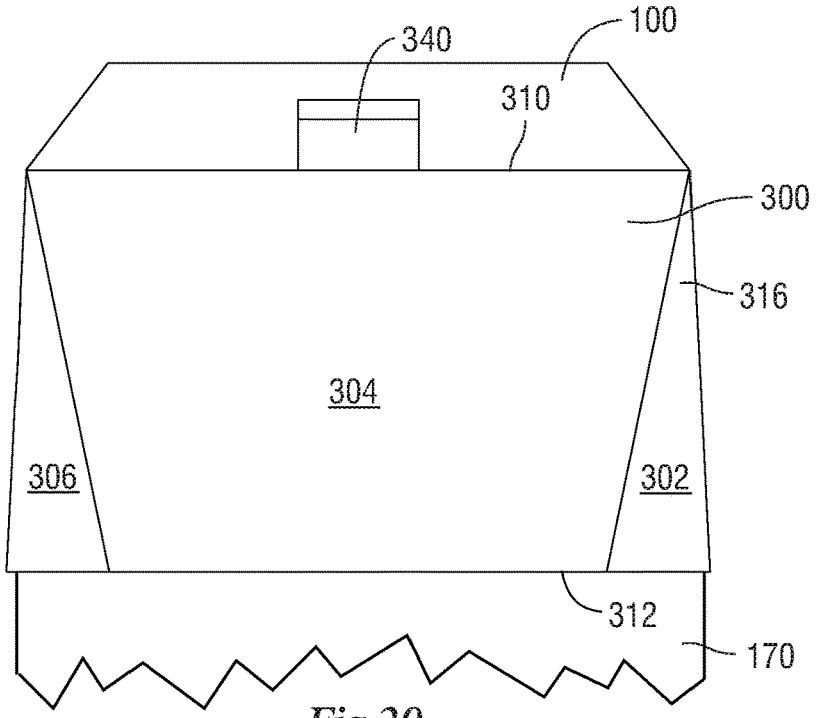
FIG. 20 is a rear view of the clamp arm support housing clamped to the solar unit and threaded to a segmented thread jar.

As shown in FIG. 20 the a solar unit 100 is fitted into the clamp arm housing 300 such that it is supported on the first, second, third and fourth internal stop walls 330, 332, 334, 336. As the solar unit 100 is moved onto the first, second, third and fourth internal stop walls 330, 332, 334, 336 the first and second clamp arms 340, 342 expand, that is they each move from the relaxed position 345 to the bent position 347 to allow passage of the solar unit 100. FIG. 20 shows the clamp arm solar jar lid 8*b* after it has been fitted on the clamp arm housing 300. As shown, each of the first and second clamp arms 340, 342 is in the relaxed position 345 and abut the solar unit 100 such the solar unit 100 is secured to and unable to separate from the clamp arm support housing 300, until the user again moves the first and second arms 340, 342 to the bend position 347 while pulling the solar unit 100 from the clamp arm housing 300.

The first, second, third and fourth engagement tabs 320*a*, 322*a*, 324*a*, 326*a* are capable of threading to the external tab engagement thread segments 172 of the segmented thread jar 170 as previously described above and shown in FIG. 20. The clamp arm housing 300 threaded to the segmented thread jar 170 as shown in FIG. 20. The clamp solar jar lid 8*b* can be sold by itself and the purchaser can use his or her own segmented thread jar 170, or the clamp solar jar lid 8*b* can be sold with the segmented thread jar 170 and the user can screw them together. In another embodiment the first, second, third and fourth engagement tabs 320, 322, 324, 326 are replaced with the previously described internal thread 52 such that the clamp arm support housing 300 can be threaded to the previously described external thread 222 of the jar 220.

Thus, the solar jar lid 8, the tab solar jar lid 8*a*, and the clamp solar jar lid 8*b* allow for the illumination of a beverage 226 in ajar 220 or a segmented thread jar 170 and as described above in low light or no light situations, and they are all powered by the rechargeable battery 136 that is charged by the solar panel 106.

It will be appreciated by those skilled in the art that while the solar jar lid 8, the tabbed solar jar lid 8*a*, and clamp solar jar lid 8*b* have been described in detail, the invention is not necessarily so limited and other examples, embodiments, uses, modifications, and departures from the embodiments, examples, uses, and modifications may be made without departing from the invention. All these embodiments are intended to be within the scope and spirit of the appended claims.

What is claimed:

1. A solar jar lid for threading to an external thread of a jar, the solar jar lid comprising:

a support housing, a solar unit supported on the support housing and wherein the solar unit is for providing energy and the support housing defines a straw opening, and, wherein the support housing further includes opposed inner and outer housing surfaces and a first end and an opposed second end, and extending from the first end are first, second, third and fourth support engagement walls, and first, second, third and fourth interior stop walls extend from the inner surface, and the first, second, third and fourth support engagement.

2. The solar jar lid according to claim 1 wherein the support housing further includes a first concave wall having opposed inner concave and outer convex surfaces, a second concave wall having opposed inner concave and outer convex surfaces, a third curved wall having opposed inner concave and outer convex surfaces, and a fourth curved wall having opposed inner concave and outer convex surfaces, and wherein the first curved wall meets with and extends from the first support engagement wall, and the second curved wall extends meets with and extends from the second support engagement wall, and the third curved wall meets with and extends from the third support engagement wall, and the fourth curved wall meets with and extends from the fourth support engagement wall and the straw opening is defined in the first support engagement wall.

3. The solar jar lid according to claim 2 wherein the support housing further includes a surrounding wall that meets with and extends from the first, second, third and fourth curved walls and the surrounding wall has opposed inner and outer wall surfaces and wherein an internal thread extends from the internal surface and the internal thread is capable of being threaded to the external thread of the jar.

4. The solar jar lid according to claim 1 wherein the solar unit includes a solar unit housing having a first solar unit housing end wall that defines a solar panel opening and having an opposed second solar unit housing end wall that defines a solar housing opening, and wherein the solar unit housing has first, second, third and fourth unit sidewalls that extend from the first solar unit housing end wall, and wherein the first unit sidewall extends to a first engagement wall, the second unit sidewall extends to a second engagement wall, the third unit sidewall extends to a third engagement wall, and the fourth unit sidewall extends to a fourth wall engagement wall, and wherein the first second, third and fourth unit sidewalls slope outwardly as they extend from the first solar unit housing end wall a direction toward the second solar unit housing end wall.

5. The solar jar lid according to claim 4 wherein the solar unit further includes a power and control housing positioned in the solar unit housing and a solar panel, a LED and a rechargeable battery that are wired to one another are positioned and supported in the power and control housing, and the power and control housing is secured to the solar unit housing, and wherein the first, second, third and fourth engagement walls of the solar unit and the a power and control housing define a slot such that the slot extends along each of the first, second, third and fourth engagement walls.

6. The solar jar lid according to claim 5 wherein the solar unit is positioned on the support housing such that the first, second, third and fourth support engagement walls of the support housing are moved into the slot and the power and control housing abuts against the first, second, third and fourth interior stop walls.

7. A tabbed solar jar lid for use with a segmented thread jar having external tab engagement thread segments, the tabbed solar jar lid comprising:

a tabbed support housing, a solar unit supported on the tabbed support housing and wherein the solar unit is for providing energy and the support housing defines a straw opening, and, wherein the tabbed support housing has opposed inner and outer housing surfaces and a first end and an opposed second end, and extending from the first end are first, second, third and fourth support engagement walls, and first, second, third and fourth interior stop walls extend from the inner surface, and the first, second, third and fourth support engagement walls meet with and extend from the first, second, third and fourth interior stop walls.

8. The tabbed solar jar lid according to claim 7 wherein the tabbed support housing further includes a first concave wall having opposed inner concave and outer convex surfaces, a second concave wall having opposed inner concave and outer convex surfaces, a third curved wall having opposed inner concave and outer convex surfaces, and a fourth curved wall having opposed inner concave and outer convex surfaces, and wherein the first curved wall meets with and extends from the first support engagement wall, and the second curved wall extends meets with and extends from the second support engagement wall, and the third curved wall meets with and extends from the third support engagement wall, and the fourth curved wall meets with and extends from the fourth support engagement wall and the straw opening is defined in the first support engagement wall.

9. The tabbed solar jar lid according to claim 8 wherein the tabbed support housing further includes a surrounding wall that meets with and extends from the first, second, third and fourth curved walls and the surrounding wall has opposed inner and outer wall surfaces and wherein surrounding wall has opposed outer and inner wall surfaces that extend to the second end of a tabbed support housing, and first, second, third and fourth engagement tabs extend from the inner wall surface and the first, second, third and fourth engagement tabs and are capable of being threaded to the external tab engagement thread segments of the segmented thread jar.

10. The tabbed solar jar lid according to claim 9 wherein the solar unit includes a solar unit housing having a first solar unit housing end wall that defines a solar panel opening and having an opposed second solar unit housing end wall that defines a solar housing opening, and wherein the solar unit housing has first, second, third and fourth unit sidewalls that extend from the first solar unit housing end wall, and wherein the first unit sidewall extends to a first engagement wall, the second unit sidewall extends to a second engagement wall, the third unit sidewall extends to a third engagement wall, and the fourth unit sidewall extends to a fourth wall engagement wall, and wherein the first second, third and fourth unit sidewalls slope outwardly as they extend from the first solar unit housing end wall a direction toward the second solar unit housing end wall.

11. The tabbed solar jar lid according to claim 10 wherein the solar unit further includes a power and control housing positioned in the solar unit housing and a solar panel, a LED and a rechargeable battery that are wired to one another are positioned and supported in the power and control housing, and the power and control housing is secured to the solar unit housing, and wherein the first, second, third and fourth engagement walls of the solar unit and the a power and control housing define a slot such that the slot extends along each of the first, second, third and fourth engagement walls.

12. The tabbed solar jar lid according to claim 11 wherein the solar unit is positioned on the tabbed support housing such that the first, second, third and fourth support engagement walls of the support housing are moved into the slot and the power and control housing abuts against the first, second, third and fourth interior stop walls.

13. A clamp arm solar jar lid for use with a segmented thread jar having external tab engagement thread segments, the clamp arm solar jar lid comprising:

a clamp arm support housing;

a solar unit supported on the clamp arm housing and wherein the solar unit is for providing energy and the support housing defines a straw opening, and, wherein clamp arm support housing has opposed inner and outer surfaces, and defines an engagement housing interior, and has first, second, third and fourth convex walls that extend from a panel engagement end to an opposed jar engagement end, and the first convex wall defines the straw opening, and the clamp are housing has extend from the inner surface first, second, third and fourth engagement tabs that are adapted to thread to the external tab engagement thread segments of the segmented thread jar.

14. The clamp arm solar jar lid according to claim 13 wherein the clamp arm support housing further includes first, second, third and fourth internal stop walls that extend from the inner surface, and first and second clamp arms that face one another extend from the panel engagement end, and wherein the first clamp arm extends at an angle relative to the panel engagement end, such that the first clamp arm extends over the second internal stop wall, and the second clamp arm extends at an angle relative to the panel engagement end, such that the second clamp arm extends over the fourth internal stop wall.

15. The clamp arm solar jar lid according to claim 14 wherein the first and second clamp arms are flexible and resilient and can each be moved from a relaxed position to a bent position, and then return to the relaxed position, such as that the solar unit is fitted into the clamp arm housing and is supported on the first, second, third and fourth internal stop walls the first and second clamp arms expand and move the relaxed position to the bent position to allow passage of the solar unit and after installation of the solar unit each of the first and second clamp arms returns to the relaxed position and abut the solar unit and hold the solar unit in place.

16. The clamp arm solar jar lid according to claim 15 wherein the solar unit includes a solar unit housing having a first solar unit housing end wall that defines a solar panel opening and having an opposed second solar unit housing end wall that defines a solar housing opening, and wherein the solar unit housing has first, second, third and fourth unit sidewalls that extend from the first solar unit housing end wall, and wherein the first unit sidewall extends to a first engagement wall, the second unit sidewall extends to a second engagement wall, the third unit sidewall extends to a third engagement wall, and the fourth unit sidewall extends to a fourth wall engagement wall, and wherein the first second, third and fourth unit sidewalls slope outwardly as they extend from the first solar unit housing end wall a direction toward the second solar unit housing end wall, and the solar unit further includes a power and control housing positioned in the solar unit housing and a solar panel, a LED and a rechargeable battery that are wired to one another are positioned and supported in the power and control housing, and the power and control housing is secured to the solar unit housing.

* * * * *